US007240787B2

(12) United States Patent
Siemer et al.

(10) Patent No.: US 7,240,787 B2
(45) Date of Patent: Jul. 10, 2007

(54) FINGER SWEEP

(75) Inventors: Wayne A. Siemer, Edgewood, KY (US); Christopher R. Wiesmann, Burlington, KY (US)

(73) Assignee: F.N. Sheppard and Company, Erlanger, KY (US)

( * ) Notice: Subject to any disclaimer, the term of this patent is extended or adjusted under 35 U.S.C. 154(b) by 471 days.

(21) Appl. No.: 10/901,391

(22) Filed: Jul. 28, 2004

(65) Prior Publication Data

US 2005/0040589 A1 Feb. 24, 2005

Related U.S. Application Data

(60) Provisional application No. 60/491,383, filed on Jul. 30, 2003.

(51) Int. Cl.
*B65G 47/82* (2006.01)

(52) U.S. Cl. ..... 198/598; 198/597

(58) Field of Classification Search ..... 198/457.01, 198/457.07, 441, 597, 598, 640, 642; 209/900
See application file for complete search history.

(56) References Cited

U.S. PATENT DOCUMENTS 3,389,821 A * 6/1968 Weichel ..... 198/598
3,528,538 A * 9/1970 Wilhelm ..... 198/598
3,621,974 A * 11/1971 Bavers ..... 198/597
6,209,706 B1 * 4/2001 Tod, Jr. ..... 198/418
6,444,936 B1 * 9/2002 Ludwig et al. ..... 198/598

FOREIGN PATENT DOCUMENTS

JP 57-62115 * 4/1982 ..... 198/457.07

OTHER PUBLICATIONS

Color photographic images of USPS N.S.N. 34.1519.055.03 manufactured by Ammeraal-Beltech, Inc.

* cited by examiner

*Primary Examiner*—James R. Bidwell
(74) *Attorney, Agent, or Firm*—Wood, Herron & Evans LLP

(57) ABSTRACT

A finger sweep for use with mail parcel handling systems includes an elongate mounting member for coupling the finger sweep to a drive shaft, and a parcel engaging member disposed on a distal end of the mounting member. In one embodiment, a pair of finger sweeps are coupled at first ends to a drive shaft such that parcel engaging members on their second ends extend in radially opposite directions. In another embodiment, an elongate mounting member is centrally attached to a drive shaft and parcel engaging members on its ends extend in radially opposite directions. The parcel engaging members are formed from polymeric material and may be removably fastened to the mounting member, or formed directly thereon.

18 Claims, 5 Drawing Sheets

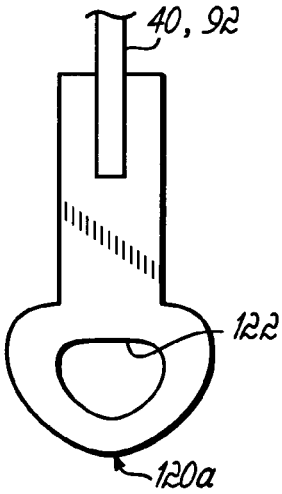
FIG. 4A
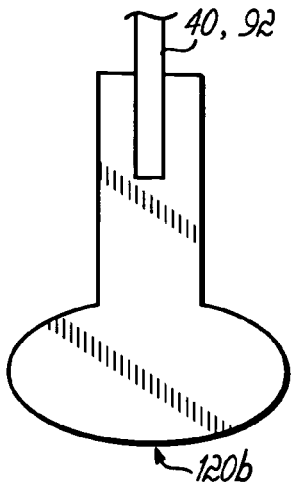
FIG. 4B
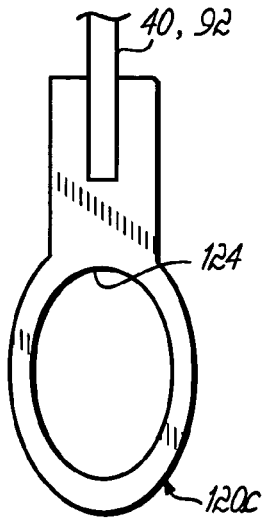
FIG. 4C
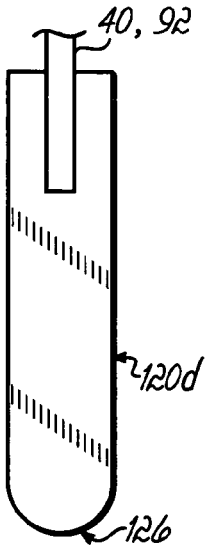
FIG. 4D
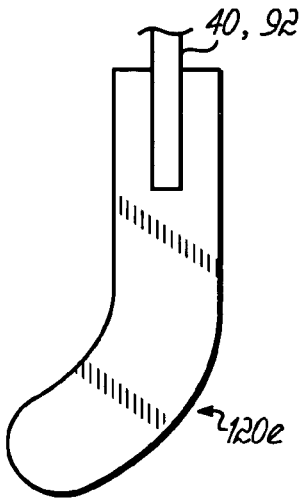
FIG. 4E
FIG. 4F
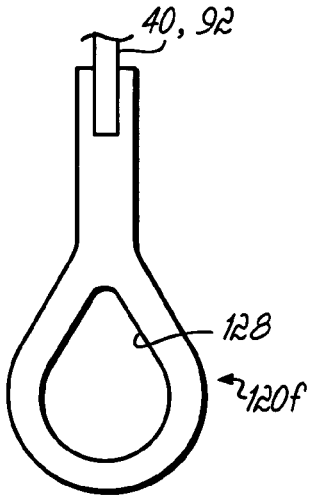

FINGER SWEEP

This application claims priority to U.S. Provisional Patent Application Ser. No. 60/491,383 filed Jul. 30, 2003, incorporated by reference herein in its entirety.

FIELD OF THE INVENTION

The present invention relates generally to automated parcel handling equipment, and more particularly to an improved finger sweep for automated parcel handling equipment.

BACKGROUND OF THE INVENTION

In the handling of mail parcels, it is conventional to use automated equipment to process and sort the parcels. For example, conventional mail systems process mail parcels through several separate machines, including an Advanced Facer Canceller System (AFCS). The AFCS receives incoming mail parcels and faces the parcels by locating the stamped or metered postage and cancelling the postage, typically by imposing a series of wavy lines upon the postage.

One part of the AFCS is configured to receive incoming bales of mail parcels and separate them for proper processing by the AFCS. Typically, this portion of the system includes two conveyors positioned adjacent one another and arranged so that their directions of travel are substantially transverse to one another. The first conveyor is inclined and receives mail parcels at a lower end of the conveyor from a vibrating table. The letters are carried up the inclined conveyor where they are engaged by devices known as finger sweeps. The finger sweeps propel the mail parcels from the first, inclined conveyor against a curtain or curved wall whereafter the mail parcels fall onto the second conveyor which is moving in a direction transverse to the first conveyor and at a higher rate of speed. In this manner, the mail parcels become separated and spaced apart on the second conveyor for processing by the remainder of the mail handling equipment.

Conventional finger sweeps generally comprise a pair of belting straps of a plied or layered construction. The belting straps are formed into respective loops and are secured at their ends to a drive shaft that is positioned above the first conveyor and extends perpendicular to the direction of travel of the first conveyor. Multiple sets of these looped-belt finger sweeps are typically secured to the drive shaft in an arrangement such that the finger sweeps are uniformly spaced across the length of the drive shaft and such that their relative angular positions are staggered. The belt straps are typically formed from the same type of belting material used in the conveyor belts and includes a low friction fabric having a top surface coating of high friction elastomer or polymer. Accordingly, as the mail parcels are conveyed up the inclined first conveyor, the drive shaft rotates the looped-belt sweeps to engage and propel the mail parcels as described above. Due to the construction of the belt straps, however, the outer, high friction surface tends to wear out and must be replaced. Because only the end portion of the belt loops contact the parcels and/or the conveyor, only a small area of the belt becomes worn, yet the entire belt must be replaced, thereby contributing to increased maintenance costs. Moreover, the need for frequent replacement of the belt straps increases the operating costs and downtime of the mail handling equipment. A need therefore exists for an improved finger sweep that overcomes these and other drawbacks of the prior art.

SUMMARY OF THE INVENTION

The present invention provides an improved finger sweep for use in parcel handling equipment. In one embodiment, the finger sweep includes an elongate mounting member having a first end configured to engage the drive shaft of the parcel handling equipment such that the mounting member extends radially therefrom. A parcel engaging member is disposed on the second end of the mounting member and has a distal end with a curved surface for engaging a parcel. Pairs of these finger sweeps are clamped to the drive shaft such that the respective mounting members extend in opposite directions.

In another embodiment, a finger sweep according to the invention includes an elongate mounting member having first and second longitudinally spaced ends and a central portion between the ends for securing the mounting member to a drive shaft. This embodiment includes first and second parcel engaging members disposed on the respective first and second ends of the mounting member, each having curved surfaces for engaging a parcel.

In each of the embodiments above, the parcel engaging member may be removably coupled to the respective ends of the mounting member and may be adjustable to vary the position of the parcel engaging member relative to the mounting member. In this manner, the finger sweep can be adjusted relative to the first conveyor to accommodate tolerance variations, variations in parcel size, and to account for surface wear of the parcel engaging member.

In another embodiment, the parcel engaging members may be molded directly onto the ends of the mounting member. In yet another embodiment of the invention, an apparatus for handling parcels includes a conveyor for transporting the parcels along a machine direction, a shaft positioned above the conveyor with its longitudinal axis substantially perpendicular to the machine direction, and a finger sweep as described above.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

FIGS. 4A-4F are schematic illustrations depicting additional embodiments of finger sweeps according to the present invention.

DETAILED DESCRIPTION

Figure 1:
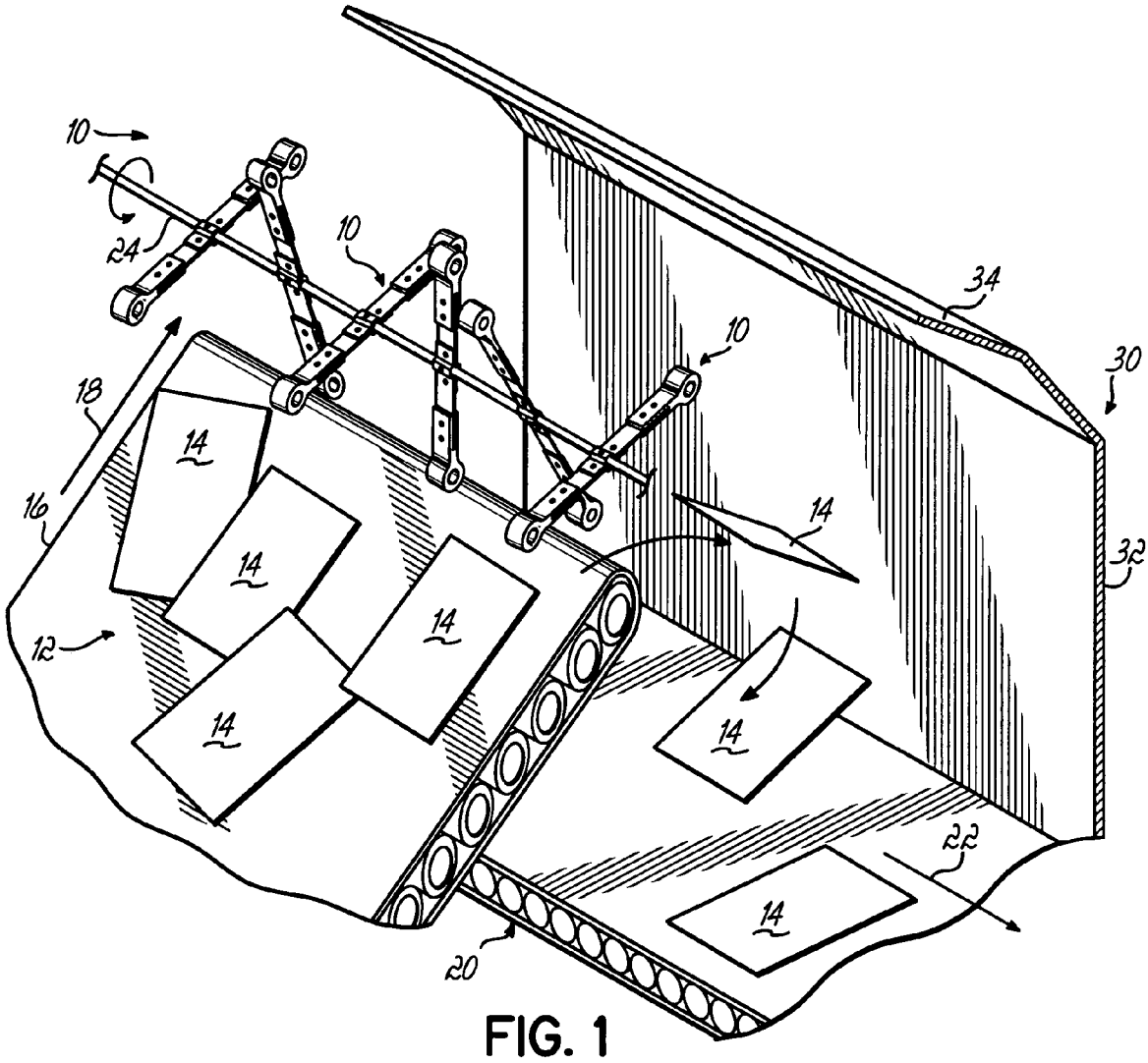
FIG. 1 is a partial perspective view of a parcel handling system incorporating exemplary finger sweeps according to the present invention.

Referring now to FIG. 1, there are shown exemplary finger sweeps 10 according to the present invention being used in a parcel handling system. The parcel handling system includes a first, inclined conveyor 12 which receives mail parcels 14 and conveys them in a direction 18 toward the raised end 16 of the conveyor. A second conveyor 20 is positioned beneath the inclined end 16 of the first conveyor 12 and moves in a direction 22 substantially transverse to the direction 18 of the first conveyor 12. The finger sweeps 10 are positioned at the inclined end 16 of the first conveyor 12 and are fixed to a rotating drive shaft 24 oriented with its longitudinal axis extending substantially perpendicular to the direction of travel 18 of the first conveyor 12. As depicted in FIG. 1, the finger sweeps 10 are spaced apart along the drive shaft 24 and are oriented such that their relative angular positions are staggered with respect to one another. The drive shaft 24 is positioned relative to the inclined end 16 of the first conveyor 12 such that the finger sweeps 10 are spaced approximately one quarter inch above the end of the conveyor 12.

As parcels 14 are carried up the incline of the first conveyor 12, the finger sweeps 10 are rotated by the drive shaft 24 and engage the mail parcels 14 to propel them from the end 16 of the conveyor 12 toward a barrier wall or curtain 30 positioned opposite the first conveyor 12 and adjacent the second conveyor 20. The barrier wall or curtain 30 has an upwardly extending back portion 32 and an upper portion 34 which extends arcuately over the second conveyor 20. The mail parcels 14 propelled by the finger sweeps 10 impact the barrier wall or curtain 30 and are directed downwardly toward the second conveyor 20. The second conveyor 20 is moving at a rate which is greater than the speed of the first conveyor 12, whereby the mail parcels 14 become separated and spaced apart on the second conveyor 20 for subsequent processing by the mail handling equipment.

Figure 2:
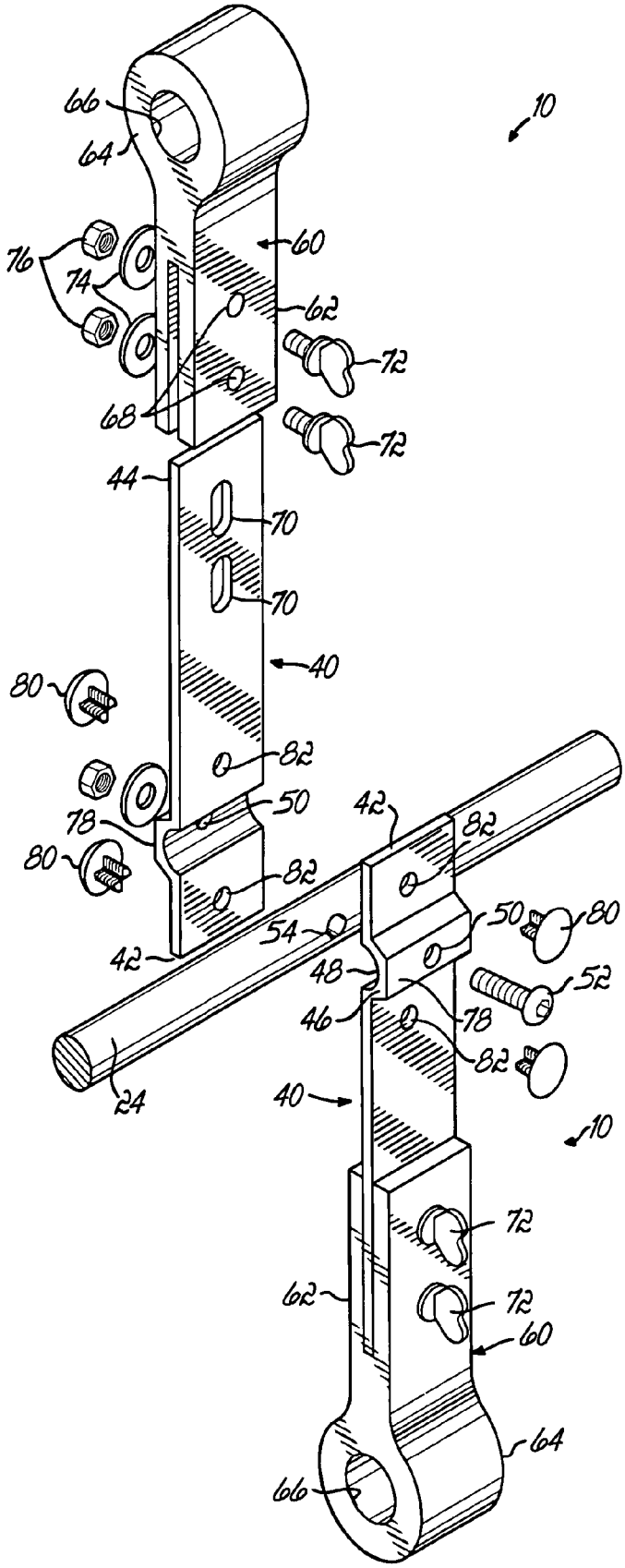
FIG. 2 is an exploded perspective view of one embodiment of a finger sweep according to the present invention.

Referring now to FIG. 2, one embodiment of a finger sweep 10 according to the present invention is shown in greater detail. In this embodiment, the finger sweep 10 includes an elongate mounting member 40 having first and second longitudinally spaced ends 42, 44. In the embodiment shown, the mounting member 40 is in the form of a generally flat strip or slat, but it will be recognized that the mounting member may have other configurations, such as an elongate rod or tube, for example.

The first end 42 of the mounting member 40 includes an offset portion 46 having an arcuate surface 48 shaped to engage the drive shaft 24 of the parcel handling equipment. A hole 50 formed through the mounting member 40 at the offset portion 46 facilitates securing the finger sweep 10 to the drive shaft 24, for example, by way of a pin or threaded fastener 52 installed through the mounting member 40 and a corresponding aperture 54 formed through the drive shaft 24. A parcel engaging member 60 is disposed on the second end 44 of the mounting member 40 and comprises a shank portion 62 engaging the mounting member 40 and a bulbous lobe 64 extending therefrom.

The parcel engaging member 60 is formed from a polymeric material such as urethane, neoprene, natural rubber, PVC or any other polymeric material suited to provide flexibility to the finger sweep 10 and exhibiting a friction coefficient sufficient to facilitate engaging and propelling mail parcels 14 from the conveyor 12. The stiffness of the mounting member 40 is generally greater than the stiffness of the parcel engaging member 60, but the mounting member 40 should still be flexible enough that it will not bind against parcels 14 or the conveyor 12 so that proper operation of the system will not be hindered. In one embodiment, the mounting member 40 is formed from injection molded polymeric or resin material. It will be recognized, however, that mounting member 40 can alternatively comprise metal, composite material, or any other material suitable to support the parcel engaging member 60 while being flexible enough to avoid binding against the parcels 14.

In the embodiment shown in FIG. 1, the parcel engaging member 60 includes an aperture 66 formed through the bulbous lobe 64. Advantageously, the aperture 66 may be formed in any desired shape or location to vary the stiffness and performance characteristics of the parcel engaging member 60. The parcel engaging member 60 is secured to the mounting member 40 by fasteners installed through holes 68 formed in the shank portion 62 of the parcel engaging member 60 and corresponding elongate slots 70 formed through the mounting member 40. In the embodiment shown, thumb screws 72, washers 74 and nuts 76 are installed through the holes 68 and slots 70 to facilitated securing the parcel engaging member 60 to the mounting member 40, and to permit adjustment of the parcel engaging member 60 with respect to the second end 44 of the mounting member 40. Advantageously, the elongate slots 70, in the mounting member 40 permit the position of the parcel engaging member 60 to be adjusted relative to the second end 44 of the mounting member 40 and thereby adjust the spacing between the conveyor 12 and the parcel engaging member 60.

In use, a pair of finger sweeps 10 are secured on opposite sides of the drive shaft 24 with their parcel engaging members 60 extending in radially opposite directions. In the embodiment shown, the pair of finger sweeps 10 are fixed to the drive shaft 24 by a threaded fastener 52 installed through the respective offset portions 46 at the first ends 42 of the mounting members 40. Advantageously, the offset portion 46 may include a flat surface 78 formed opposite the arcuate surface 48 of the mounting member 40 to facilitate proper clamping of the threaded fasteners 52. Additional fasteners, such as ratchet rivets 80, may be installed through apertures 82 formed through the mounting member 40, on opposite sides of the drive shaft.

Figure 5A:
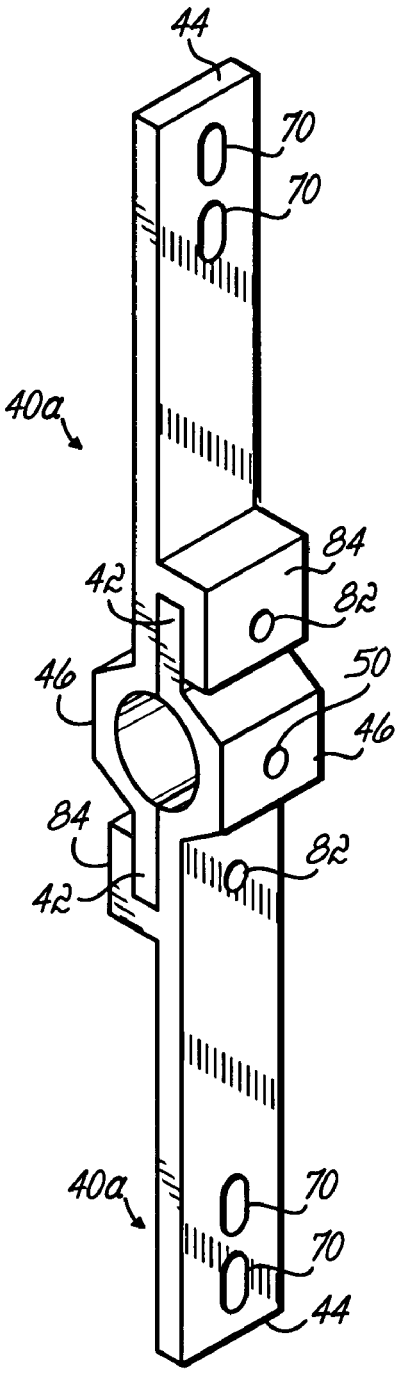
FIGS. 5A-5B are perspective detail views depicting exemplary mounting members of finger sweeps in accordance with the present invention.
Figure 5B:
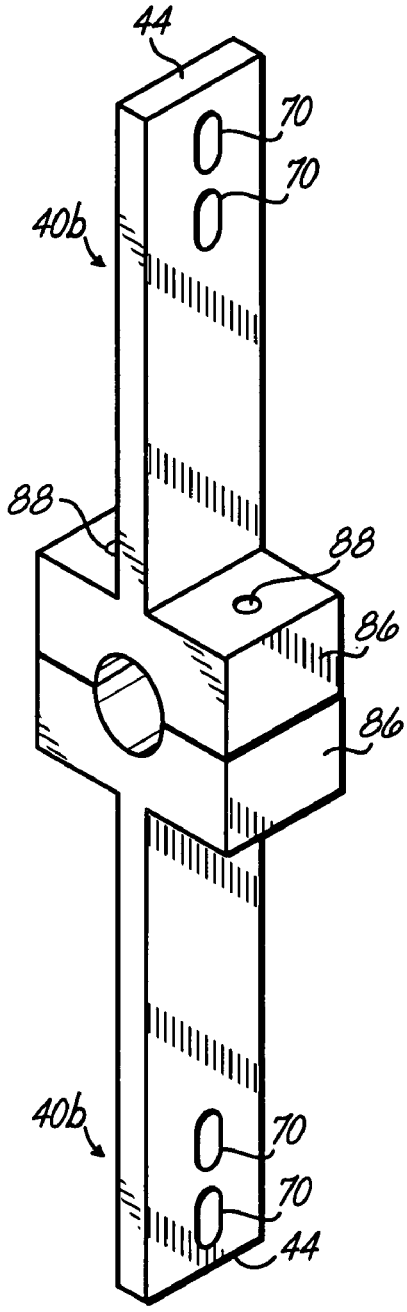

FIGS. 5A and 5B depict additional embodiments of mounting members configured to facilitate securing finger sweeps to a drive shaft 24. In FIG. 5A, mounting members 40*a* are formed from injection molded polymeric material and are similar to the mounting member shown in FIG. 2. Mounting members 40*a* further include outwardly projecting tangs 84 disposed between offset portions 46 and second ends 44. The tangs 84 of mating mounting members 40*a* are configured to interlock with the first ends 42 of the respectively associated mounting member 40*a*. In FIG. 5B, mounting member 40*b* is formed from injection molded polymer and has an enlarged first end defining block-shaped mounting lands 86. Apertures 88 are formed through the mounting lands 86, on each side of the mounting member 40*b*, and extend along directions substantially parallel to a longitudinal direction of the mounting member 40*b* so that pairs mounting members 40*b* can be clamped to a drive shaft and secured with fasteners installed through apertures 88.

Figure 3:
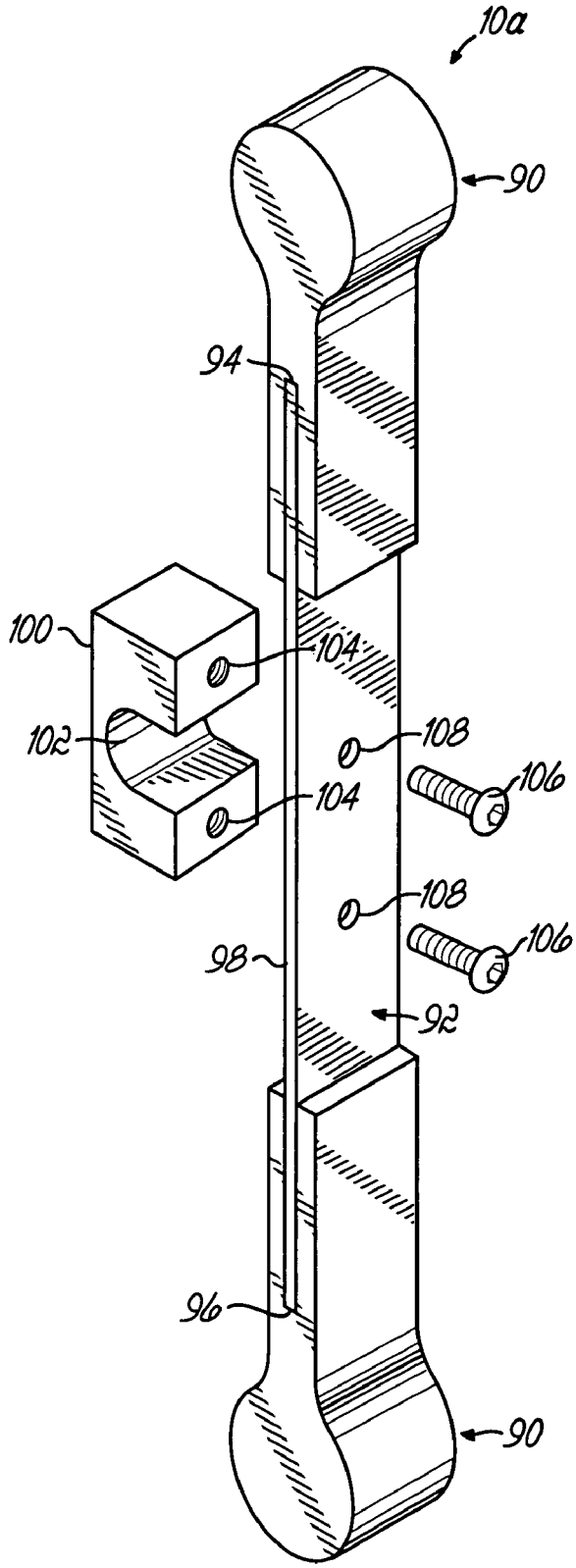
FIG. 3 is a perspective view of another embodiment of a finger sweep according to the present invention.

While the parcel engaging member is shown and described above as being removably fastened to the second end of the elongate member, it will be recognized that the parcel engaging member may alternatively be molded or otherwise formed directly onto the second end of the elongate mounting member, as depicted in FIG. 3 described below.

Referring now to FIG. 3, there is shown another exemplary embodiment of a finger sweep 10*a* according to the present invention. In this embodiment, first and second parcel engaging members 90 are secured to a single elongate mounting member 92. Accordingly, the elongate mounting member 92 has first and second longitudinally spaced ends 94, 96 and a central portion 98 between the ends for securing the finger sweep 10*a* to the drive shaft 24 of the parcel handling system. In the embodiment shown, the elongate member 92 is secured to the drive shaft 24 by a clamping block 100 having an arcuate recess 102 formed into one side. The arcuate recess 102 is sized to fit over the drive shaft 24. Tapped holes 104 are formed in the clamping block, on either side of recess 102, for receiving fasteners 106 inserted through corresponding apertures 108 in the mounting member 92 to thereby clamp the finger sweep 10*a* onto the drive shaft 24. In the embodiment shown, the parcel engaging members 90 are generally similar to the parcel engaging member 60 shown and described in FIG. 2, except that the parcel engaging members 90 do not include apertures formed through the bulbous lobe and are molded, or otherwise formed directly onto the ends 94, 96 of the mounting member 92, instead of being removably fastened to the mounting member 92.

While the finger sweeps 10, 10*a* have been shown and described above having parcel engaging members 60, 90 with generally cylindrically shaped lobes, it will be recognized that the parcel engaging members may have other configurations suited to engage and propel parcels 14 from the first conveyor 12. For example, a parcel engaging member 120*a* may have a generally tri-lobed shape as depicted in FIG. 4A, or generally oval cross-sectional shapes 120*b*, 120*c* as depicted in FIGS. 4B and 4C. The parcel engaging members may include apertures 66, 122, 124 formed therethrough, as depicted in FIGS. 2, 4A and 4C, or may be of generally solid construction as depicted in FIGS. 3 and 4B.

FIGS. 4D and 4E illustrate embodiments of a finger sweep wherein the parcel engaging members 120*d*, 120*e* do not have a bulbous configuration. In FIG. 4D, the parcel engaging member 120*d* has a generally elongate shape with a curved end surface 126. FIG. 4E depicts an exemplary parcel engaging member 120E having a generally arcuate elongate shape. FIG. 4F depicts another embodiment of a finger sweep wherein the parcel engaging member 120*f* has a bulbous configuration with an aperture 128 similar to that depicted in FIG. 4A, but wherein the distal end has a more circular shape. It will be recognized that various other configurations of the parcel engaging member are possible and the invention is not limited to the configurations shown and described.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A finger sweep for use in parcel handling equipment, comprising:

an elongate mounting member having first and second longitudinally spaced ends, said first end shaped to engage a shaft such that said mounting member extends radially therefrom; and a pliable parcel engaging member disposed on said second end of said mounting member, said parcel engaging member having a distal end opposite said mounting member, said distal end having a curved surface for engaging a parcel.

2. The finger sweep of claim 1, wherein said parcel engaging member is removably coupled to said second end of said mounting member.

3. The finger sweep of claim 2, wherein said parcel engaging member is adjustable to vary the position of said parcel engaging member relative to said second end of said mounting member.

4. The finger sweep of claim 1, wherein said parcel engaging member is molded onto said second end of said mounting member.

5. The finger sweep of claim 1, wherein said distal end of said parcel engaging member includes a generally bulbous lobe.

6. The finger sweep of claim 5, further comprising a cavity formed in said bulbous lobe of said parcel engaging member.

7. The finger sweep of claim 1, wherein said mounting member has a stiffness that is greater than a stiffness of said parcel engaging member.

8. The finger sweep of claim 1, wherein said parcel engaging member is formed from a polymeric material.

9. The finger sweep of claim 1, wherein said mounting member is formed from a resin material.

10. A finger sweep, comprising:

an elongate mounting member having first and second longitudinally spaced ends and a central portion between said ends, said central portion shaped to engage a shaft such that said first and second ends extend radially therefrom; and first and second parcel engaging members disposed on said first and second ends of said mounting member, each said parcel engaging member having a distal end opposite said mounting member, said distal end having a curved surface for engaging a parcel.

11. The finger sweep of claim 10, wherein said first and second parcel engaging members are removably coupled to said first and second ends of said mounting member, respectively.

12. The finger sweep of claim 10, wherein said first and second parcel engaging members are molded onto said first and second ends of said mounting member, respectively.

13. An apparatus for handling parcels, comprising:

a conveyor for transporting parcels along a machine direction;

a shaft positioned above said conveyor and having a longitudinal axis substantially perpendicular to said machine direction; and a finger sweep coupled to said shaft, said finger sweep comprising:

an elongate mounting member having a shaft engaging portion coupled to said shaft and a distal end extending radially from said shaft, and a pliable parcel engaging member disposed on said distal end of said mounting member, said parcel engaging member having a distal end opposite said mounting member, said distal end having a curved surface for engaging a parcel.

14. The apparatus of claim 13, wherein said shaft engaging portion is positioned between respective ends of said mounting member; and wherein a parcel engaging member is disposed on each said end of said mounting member.

15. The apparatus of claim 13, wherein said parcel engaging member is removably coupled to said distal end of said mounting member.

16. The apparatus of claim 13, wherein said parcel engaging member is molded onto said distal end of said mounting member.

17. A finger sweep for transferring articles, comprising:

an elongate mounting member having first and second longitudinally spaced ends, said first end shaped to engage a shaft such that said mounting member extends radially therefrom; and an independent article engaging member attached to said second end of said mounting member, said article engaging member having a pliable distal end opposite said mounting member for engaging and transferring articles beyond said finger sweep.

18. A finger sweep for transferring articles, comprising:

an elongate mounting member having a shaft engaging portion coupled to said shaft and a distal end extending radially from said shaft; and a molded article engaging member disposed on said distal end of said mounting member, said parcel engaging member having a distal end opposite said mounting member for engaging and transferring articles beyond said finger sweep.

* * * * *